US005135181A

United States Patent [19]

Wesselink

[11] Patent Number: 5,135,181

[45] Date of Patent: Aug. 4, 1992

[54] CABLE WINDER

[75] Inventor: Pieter Wesselink, Hoogeveen, Netherlands

[73] Assignee: U.S. Philips Corp., New York, N.Y.

[21] Appl. No.: 651,044

[22] Filed: Feb. 4, 1991

Related U.S. Application Data

[63] Continuation of Ser. No. 93,456, Sep. 4, 1987, abandoned.

[30] Foreign Application Priority Data

Sep. 25, 1986 [NL] Netherlands ..... 8602417

[51] Int. Cl.[5] ..... B65H 75/48

[52] U.S. Cl. ..... 242/107.3; 242/107.6

[58] Field of Search ..... 242/107.3, 107.6, 107.7; 191/12.2 R, 12.4

[56] References Cited

U.S. PATENT DOCUMENTS 4,270,708 6/1981 Vonk ..... 242/107.6 X

FOREIGN PATENT DOCUMENTS 1544232 4/1979 United Kingdom .

*Primary Examiner*—John M. Jillions

*Attorney, Agent, or Firm*—Ernestine C. Bartlett

[57] ABSTRACT

A cable winder is provided which comprises a frame plate 1 carrying a shaft 2 on which a spring-loaded drum 3 is mounted for rotation, a rotatable speed regulator 8 comprising a hub 9, which is adapted to be driven by a flange 16 of the drum, and a braking mechanism 18 for braking the drum. In order to minimize the number of parts the braking mechanism 18 and the speed regulator 8 are combined for form a single part, in such a way that the braking mechanism acts on the hub 9 of the speed regulator. For this purpose the hub 9 engages in a wedge-shaped gap 20 formed between a brake shoe 19 and the drum flange 16.

6 Claims, 1 Drawing Sheet

CABLE WINDER

This is a continuation of application Ser. No. 093,456, filed Sep. 4, 1987, now abandoned.

The invention relates to a cable winder comprising a frame plate, provided with a shaft on which a spring-loaded drum is mounted for rotation, a rotatable speed regulator provided with a hub which is adapted to be driven by a flange of the drum, and a braking mechanism for braking the drum.

BACKGROUND OF THE INVENTION

Such a cable winder is known from U.S. Pat. No. 4,270,708, issued Jun. 2, 1981 and commonly assigned herewith. In this cable winder the braking mechanism and the speed regulator are mounted in the cable winder as separate parts.

It is an object of the invention to integrate the braking mechanism and the speed regulator in the above cable winder into a single part.

SUMMARY OF THE INVENTION

The aforementioned object is accomplished by the provision of this cable winder in accordance with this invention characterized in that the braking mechanism acts on the hub of the speed regulator.

This has the advantage that not only the number of parts for the cable winder is reduced but also that assembling the cable winder is simplified.

In a preferred embodiment of the cable winder in accordance with the invention, the braking mechanism comprises a regulator-brake disc which is rotatable relative to the shaft of the drum, which brake disc carries a pin which is situated at a distance from the shaft and on which the hub of the speed regulator is journaled, and wherein the braking mechanism further comprises a brake shoe which is secured to the frame plate and which together with the flange of the drum constitutes a wedge-shaped gap in which the hub of the speed regulator can be braked.

In a further embodiment of the cable winder, the rotatable regulator-brake disc is urged in the take-up direction of the drum by a spring and there are provided means for rotating the regulator-brake disc against the force of the spring. Thus, it is achieved that the hub of the speed regulator is withdrawn from the wedge-shaped gap to allow a cable to be taken up automatically by the spring-loaded drum.

In yet another embodiment of the invention, the cable winder has a rotatable regulator-brake disc formed with an opening in which the shaft of the drum engages and around which the brake disc is rotatable, which opening has an elongate shape, so that the brake disc has freedom of movement in a radial direction and is biased in a radial direction by a spring, causing the hub of the regulator to abut against the drum flange.

Preferably, the spring load on the regulator-brake plate both in a radial direction and in a circumferential direction is provided by a single spring.

DESCRIPTION OF THE DRAWINGS

An embodiment of the invention will now be described in more detail, by way of example, with reference to the accompanying drawings. In the drawings.

DETAILED DESCRIPTION OF THE PREFERRED EMBODIMENTS

Figure 1:
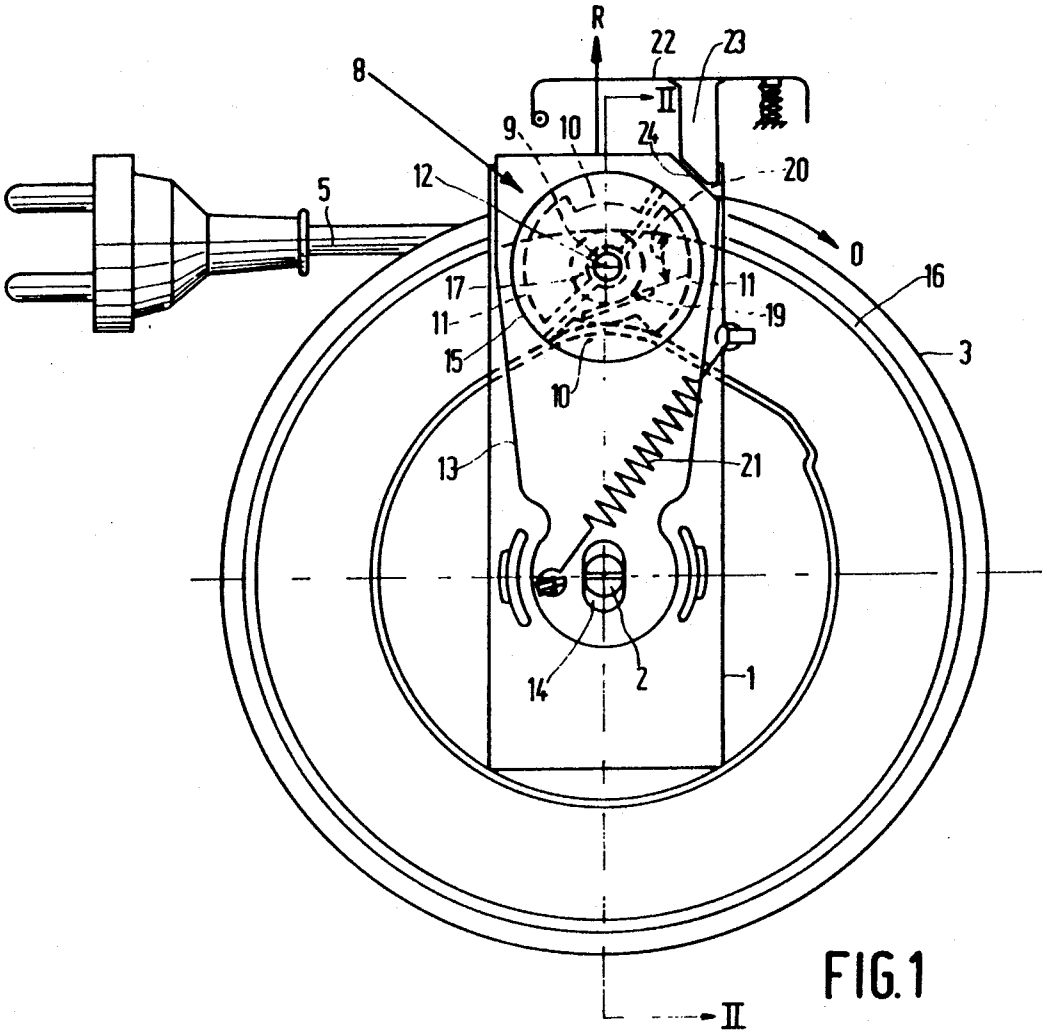
FIG. 1 is a view of the cable winder.
Figure 2:
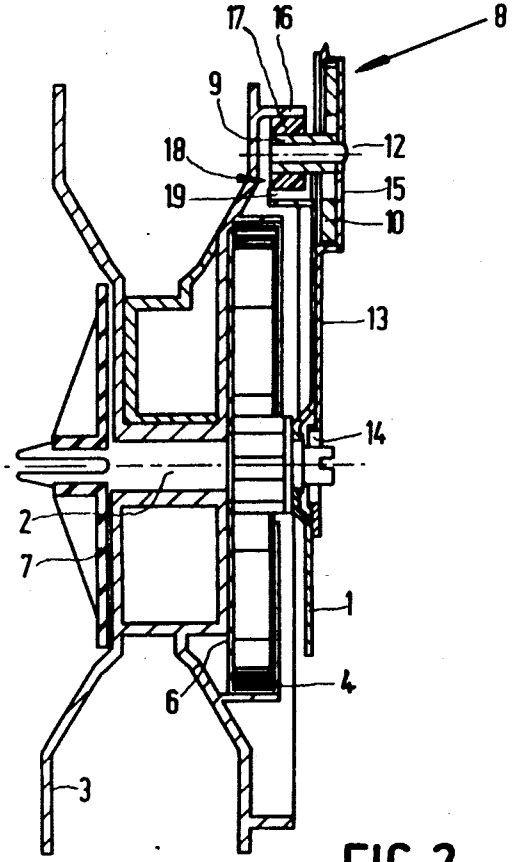
FIG. 2 is a cross-sectional view of the cable winder taken on the line II—II in FIG. 1.

The cable winder, which is adapted to be incorporated in, for example, a vacuum cleaner, comprises a frame plate 1 on which a shaft 2 is mounted perpendicularly. A drum 3 is mounted for rotation on the shaft 2. A spiral spring 4 is arranged between the frame plate and the drum to provide automatic take-up of a cable 5 on the drum. The spiral spring is situated in a closed spring housing 6, which is rigidly connected to the drum at its circumference. One end of the spring is connected to the spring housing, whilst the other end is connected to the stationary shaft 2. The free end of the shaft carries a contact disc 7, which also serves as a retaining ring to retain the drum in the axial direction.

The cable winder further has a speed regulator 8 comprising a hub 9, to which two diametrally opposed centrifugal weights 10 are connected by means of elastic arms 11. The hub is rotatable about a pin 12. This pin is secured perpendicularly to a regulator-brake disc 13. The brake disc is formed with an opening 14, through which the shaft 2 extends, so that the brake disc is rotatable about the shaft 2. The pin 12 is situated at a distance from the shaft 2. The centrifugal weights 10 are enclosed by a regulator housing 15, comprising the regulator-brake disc 13. The hub 9 of the regulator is adapted to be driven by a flange 16 of the rotatable drum 3. In order to increase the frictional contact between the hub 9 and the flange 16, the hub is provided with a rubber or plastics friction ring 17. When the regulator is driven by the drum the centrifugal weights 10 move radially outwards and rub against the inner wall of the regulator housing 15, thereby limiting the speed of rotation of the regulator and hence that of the drum, to ensure that the cable 5 is taken up uniformly.

The cable winder further comprises a braking mechanism 18 for stopping the motion of the drum and keeping it in this condition. For this purpose the braking mechanism, in addition to the said rotatable regulator-brake disc 13 comprising the rotatable regulator 8 with the hub 9, also comprises a brake shoe 19 constituted by an obliquely bent portion of the frame plate 1. The brake shoe 19 together with the flange 16 of the drum constitutes a wedge-shaped gap 20 in which the hub 9 provided with the friction ring 17 is situated. The braking mechanism further comprises a helical spring 21 which is tensioned between the regulator-brake disc 13 and the frame plate 1 to load the regulator-brake disc in the take-up direction 0 of the drum. Instead of a helical spring a leaf spring may be used. The wedge-shaped gap between the brake shoe 19 and the flange 16 is oriented in such a way that the hub 9 is pulled into the wedge-shaped gap by the spring 21 and during automatic take-up of the cable it is braked, stops, and is kept in this stationary condition. The friction between the hub and the drum flange also brakes and stops the drum.

In order to ensure a satisfactory contact between the hub and the drum flange the opening 14 in the brake disc 13 is given an elongate shape in the direction of the regulator pin 12. As a result of this, the brake disc has freedom of movement in a radial direction R. The spring 21 not only pulls the brake disc 13 in the direction 0 but also in the direction R relative to the frame plate 1, so that the hub 9 with the friction ring 17 properly lies against the drum flange 16.

In order to take up an unwound cable there are provided means to rotate the brake disc 13 against the force of the spring 21 in a direction opposite to the take-up direction 0. As a result of this the hub 9 of the regulator is withdrawn from the wedge-shaped gap 20, to release the drum 3 and take up the cable 5 under the influence of the spiral spring 4. The means for rotating the brake disc comprise a spring-loaded actuating knob 22, shown schematically, comprising a pin 23 which acts on an inclined surface 24 of the brake plate 13.

What is claimed is:

1. A cable winder which comprises:

a frame plate;

a shaft;

a spring-loaded drum having at least one flange, said drum being mounted for rotation on said shaft;

a rotatable speed regulator comprising a hub which is drivable by said drum flange; and a braking mechanism comprising a regulator brake disc rotatable relative to the shaft and including a pin on which the hub of the speed regulator is journaled, said braking mechanism further comprising a brake shoe secured to the frame plate which, together with the flange of the drum, constitutes a wedge-shaped gap in which braking is effected by engagement of the hub with the brake shoe and the drum flange.

2. A cable winder as claimed in claim 1, wherein the rotatable regulator-brake disc is urged in the take-up direction of the drum by a spring and means are included for rotating the regulator-brake disc against the force of said spring.

3. A cable winder as claimed in claim 2, wherein the rotatable regulator-brake disc is formed with an opening in which the shaft of the drum engages and around which the brake plate is rotatable, which opening in the brake disc has an elongate shape, the brake disc having freedom of movement in a radial direction and being biased in a radial direction by the spring thereby causing the hub of the regulator to abut against the drum flange.

4. A cable winder as claimed in claim 3 wherein the spring load on the regulator-brake disc both in a radial direction and in a circumferential direction is provided by a single spring.

5. A cable winder which comprises:

a frame plate;

a shaft;

a spring-loaded drum having at least one flange, said drum being mounted for rotation on said shaft;

a rotatable speed regulator for limiting the speed of rotation of the drum comprising a hub which is drivable by said drum flange;

a braking mechanism which comprises (i) a brake disc for stopping the motion of the drum loaded with a spring in the take-up direction of the drum, said disc having an opening through which the shaft extends and being secured to a pin about which said speed regulator hub rotates; and (ii) a brake shoe secured to the frame plate, the brake shoe and the drum flange forming a gap in which the hub is situated; and means to rotate the brake disc in a direction opposite to the take-up direction whereby the hub is withdrawn from the gap to allow take-up of the cable by the spring-loaded drum.

6. A cable winder which comprises:

a frame plate;

a shaft mounted on said frame plate;

a spring-loaded drum having at least one flange, said drum being mounted for rotation on said shaft; and a braking mechanism comprising:

(a) a regulator brake disc rotatable relative to the shaft;

(b) a rotatable speed regulator comprising a hub which is drivable by said drum flange and rotates about a pin secured to and carried by said regulator brake disc; and (c) a brake shoe secured to the frame plate, which together with the drum flange constitutes means by which braking is effected by engagement of the hub with the brake shoe and the drum flange.

* * * * *